United States Patent [19]

Notheis

[11] Patent Number: 4,478,354

[45] Date of Patent: Oct. 23, 1984

[54] MELTBLOWN MICROFIBER WIPER PACKAGE, DISPENSING SYSTEM THEREFOR

[75] Inventor: Patrick J. Notheis, Marietta, Ga.

[73] Assignee: Kimberly-Clark Corporation, Neenah, Wis.

[21] Appl. No.: 383,660

[22] Filed: Jun. 1, 1982

[51] Int. Cl.[3] ..... A47K 10/20

[52] U.S. Cl. ..... 221/34; 221/48; 221/63

[58] Field of Search ..... 221/33–34, 221/48–54, 63

[56] References Cited

U.S. PATENT DOCUMENTS

| | | | |
|---|---|---|---|
| 3,459,329 | 8/1969 | Mochizuki et al. | 221/34 |
| 3,490,645 | 1/1970 | Glass et al. | 221/48 |
| 3,780,908 | 12/1973 | Fitzpatrick et al. | 221/48 |
| 3,855,046 | 12/1974 | Hansen et al. | 604/366 X |
| 3,978,185 | 8/1976 | Buntin et al. | 264/518 |
| 4,197,964 | 4/1980 | Pryor | 221/50 |

*Primary Examiner*—Charles A. Marmor

*Attorney, Agent, or Firm*—R. Jonathan Peters; P. A. Leipold; G. E. Croft

[57] ABSTRACT

A shipping package for dispensing industrial size meltblown microfiber wipers therefrom. The wipers are folded in alternating opposite directions and joined to the next wiper by a plurality of perforated teeth forming a substantially continuous web of separable wipers. Two such webs are interfolded in a particular manner, i.e., a first web superposed over a second web but having the second web lagging the first web by at least one and one-half segments of a folded wiper. The package includes dispensing port for initiating breakage of the perforation teeth joining a lead wiper to a trailing wiper as a lead wiper is being dispensed. Also the dispensing port includes structure for opposing adherence of microfibers from wiper segments of one web to microfibers from wiper segments of the other web as the lead wiper is being dispensed from the carton and is being removed from the interfolded web.

2 Claims, 4 Drawing Figures

MELTBLOWN MICROFIBER WIPER PACKAGE, DISPENSING SYSTEM THEREFOR

BACKGROUND OF THE INVENTION

The present invention relates generally to novel package systems and particularly to a combination hand carried dispensing and unitary carton-shipping package system for industrial size meltblown microfiber wipers.

Dispensing systems for dispensing industrial size wipers formed of cellulose materials such as creped wadding material wipers are well known. Also it is well known to dispense interfolded cellulose type wiper webs from a carton. Such interfolded webs are normally serpentine folded and are stored in a stack in a carton that usually employs plastic lips within the dispensing port of the carton for separating each succeeding wiper extracted from the stack through the port. The plastic lips also provide a grasping action for holding the trailing wiper so that any fall-back effect is eliminated.

Such a wiper carton having plastic lips in the dispensing port to facilitate dispensing is not suitable for dispensing meltblown microfiber wipers. When it is attempted to similarly dispense two webs of wiper material that has been interfolded and stacked in a carton with the plastic lip type dispensing port normally used to dispense interfolded wipers, separation of the lead wiper from the trailing wiper becomes difficult. Separation difficulties exist because the abrasion resistance of the two meltblown webs is high and a very high coefficient of friction exists between materials having similar and high surface resistance causing mechanical bonding of the two adhering webs that are superposed upon the other to occur. Also when the wipers are connected together in a continuous web by perforation teeth, such meltblown webs are virtually impossible to dispense from the known cartons which provide means for dispensing interfolded wiper webs.

Realizing problems which exist such as the inconvenience of physically detaching each wiper along perforations from a continuous meltblown material web, a search for various other means to effect meltblown wiper dispensing was initiated. This search resulted in the improved system of the present invention.

BRIEF SUMMARY OF THE INVENTION

The present invention relates to a novel package for dispensing meltblown microfiber wiper webs from the package. The package includes two stacks of interfolded meltblown microfiber wiper webs stored in two compartments and a pair of dispensing ports disposed in a top panel of said package that permit entry into the compartment. The ports are shaped to provide means for initiating breakage of the perforated teeth connecting the wipers together in continuous webs; and to provide means for opposing physical adherence of one web against the other during serial removal of the wipers from each stack.

DETAILED DESCRIPTION OF THE DRAWINGS

Figure 1:
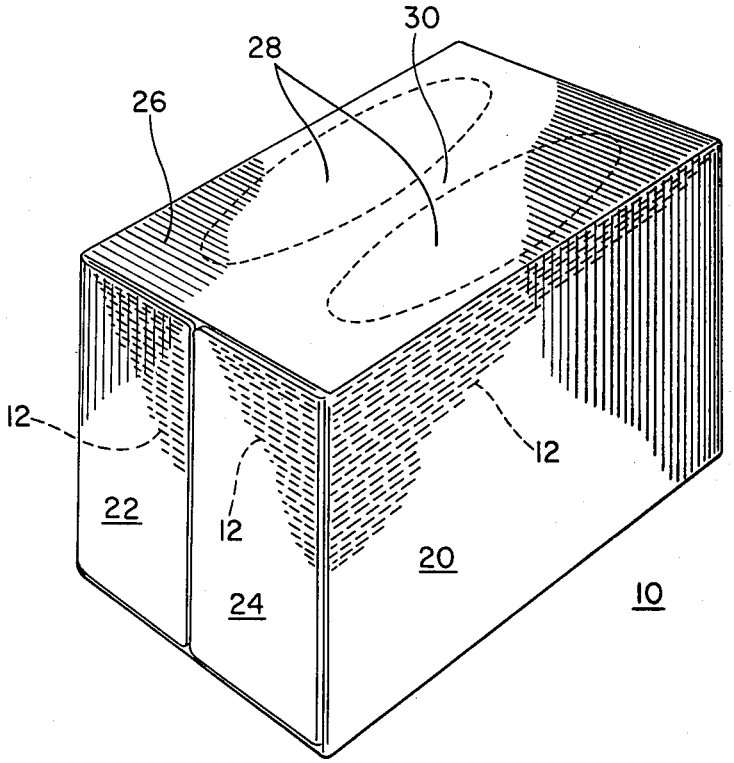
FIG. 1 is a perspective view of a combination carton and shipping package.

FIG. 1 shows a combination carton and shipping package 10 illustrative of the dispensing system of this invention for dispensing separable meltblown microfiber wipers 12—12 from interfolded webs 14 and 16 respectively disposed in package 10.

Package 10 includes a carton 20 comprised of a pair of contiguous storage compartments 22 and 24 respectively; each compartment is used to house seventy-six folded but separable wipers stored as a stack in an interfolded format web 12. Carton 20 has a top panel 26 which includes two elongated elliptically shaped perforated regions 28—28, which when removed, form two side-by-side dispensing ports 28A—28A. Dispensing ports 28A—28A are used when dispensing the wipers 12—12 from the stack of wipers stored in the storage compartments of the package and are used in combination to form a hand opening for grasping a handle panel 30 used for hand carrying an open package.

Figure 2:
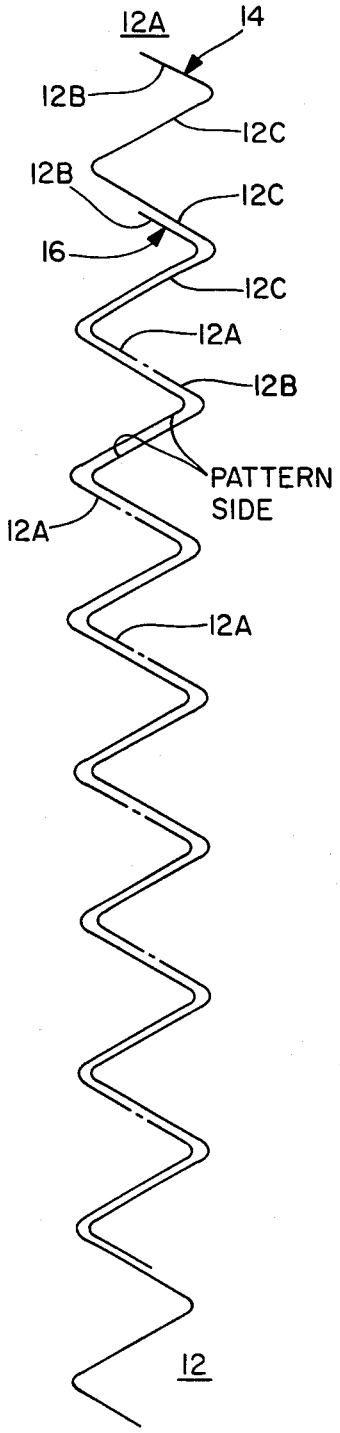
FIG. 2 is a plan view of the interfolded web format.

Each interfolded format web 12 best shown in FIG. 2 is comprised of a first web 12 and a second web 16 interfolded within web 14. Both webs 14 and 16 are, illustratively, a single-ply meltblown polypropylene microfiber web of the type as described in U.S. Pat. No. 3,978,185 to Buntin et al having a basis weight in the range of from about 0.5 oz./yd.$^2$ to 6 oz./yd.$^2$ including fibers of an average diameter in the range of up to about 10 microns. Web material produced in the manner described in the Buntin et al patent has a very clingy and fluffy structure; the structure is bulky and without much physical strength; the highly dispersed fibers of the material are made wettable by the inclusion of an ionic or nonionic surfactant, preferably in amounts of about 0.1% to 1% by weight providing a meltblown material that is substantially completely hydrophilic as well as oleophilic.

In order to change this meltblown web material to provide a web having a strength characteristic and of a lower abrasion resistance suitable for industrial wiper applications, this material is further treated by well known pattern bonding techniques employing a chosen bonding pattern on a pattern roll used for bonding the fibers together over from about 5 to 35% of the surface area of the web. The bonding temperature is preferably in the range from about 180° F. to 245° F. with a pressure illustratively in the range from about 10 PSIG to 30 PSIG between the pattern roll and an anvil roll. The resulting bonded web is a continuous microfiber nonwoven web containing an intermittent pattern of discrete compacted areas within which the microfibers are strongly and autogenously bonded. The surfaces of the compacted areas are film-like in appearance. When viewed under a microscope, the presence of extensive fusion between microfibers and the loss of filament identity are apparent. The fibers adjacent the compacted areas are lightly bonded to provide initial web stiffness and an improved abrasion resistance. Reference may be had to U.S. Pat. No. Des. 262,747 of M. Dallas Erickson and U.S. Pat. No. 3,855,046 of R. Brock for further illustrations of bonding patterns and conditions.

Figure 2A:
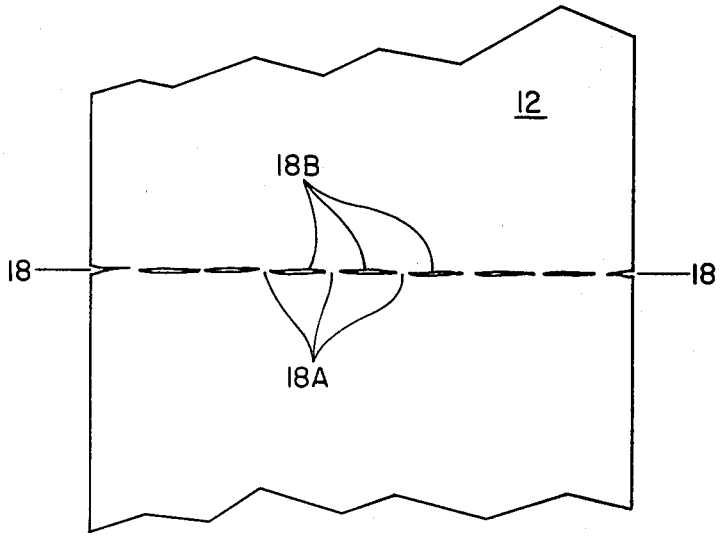
FIG. 2A is a plan view illustrating an interconnecting perforation line.

Both first and second webs 14 and 16 respectively, have a thickness of approximately 0.5 mils, a width of 12 inches and a length of at least 16 feet, with a plurality of transverse perforation lines spaced substantially along and transverse to the machine direction of the web, illustratively every 17 inches. These perforation lines 18—18 form a plurality of separable wipers, providing in the preferred embodiment at least 38 wipers per web. Illustratively, each of the lines 18—18 comprises in the preferred embodiment eight (8) teeth or bond tabs which are at least 0.012 inches wide and ten (10) slits which are at least 0.560 inches long; the two bond tabs at the extremities of line 18 are positioned inwardly from the edges of the web by at least 0.300 inches leaving slits extending to the edges. (See FIG. 2A.) These perforation teeth and slits are capable of being severed or broken in a controlled manner by means disclosed by this invention.

Figure 3:
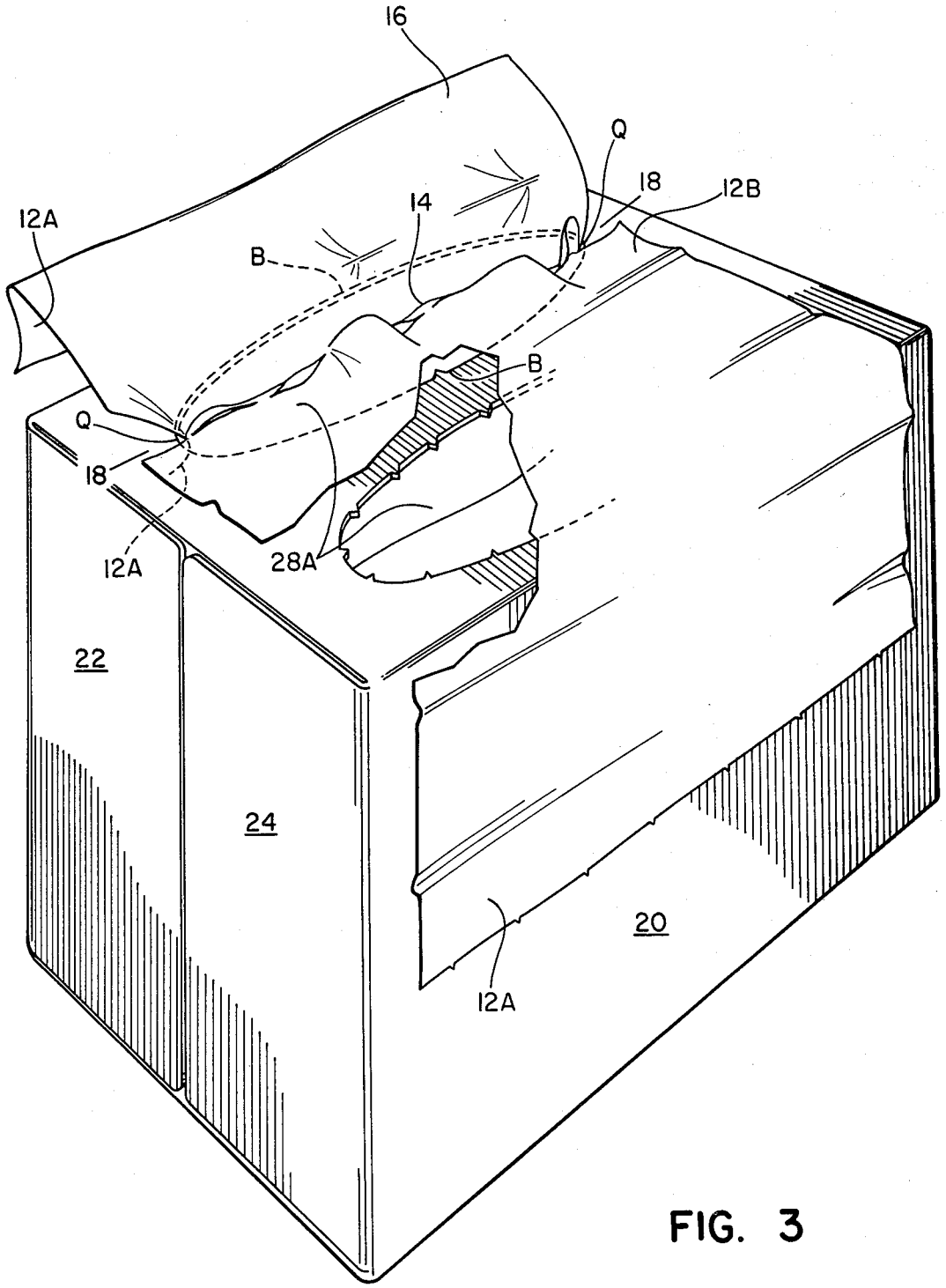
FIG. 3 is a perspective view of an open package with a lead wiper being dispensed and a trailing wiper being positioned for dispensing at a later time.

Both webs 14 and 16 are folded into a plurality of individually folded separable wipers, each separable wiper being folded in alternating opposite directions. In the preferred embodiment, each separable wiper is folded into 4×12 inch units within the substantially continuous web, the perforation line 18—18 preventing the web from being a totally continuous web. Illustratively, each separable wiper is folded to comprise a first half-size segment, three (3) full-size segments 12C—12C and a second half-size segment 12D. Web 16 is interfolded with web 14 with the pattern roll surface of web 16 superposed upon the pattern roll surface of web 14 but offset by two half segments and one full segment as illustrated in FIG. 2. The wipers are folded to include half segments to perpetuate ease of dispensing each separable wiper 12 from carton 20. It is believed the surface of the webs formed by the pattern roll have a slightly smaller abrasion resistance characteristic than the anvil roll surface of the web despite the fact that two materials having the same surface abrasion characteristic when superposed upon the other have a higher coefficient of friction then two materials having different surface abrasion characteristics. It is also believed the pattern roll side of the webs has imprints of a slightly greater depth than the print of the anvil roll thus providing larger stand-off indentations on the pattern roll side which reduces the coefficient of friction between the webs when the webs are interfolded. The thus folded webs 12—12 are compressed and then stored in storage compartments 22 and 24 as shown in FIG. 1 for shipment and dispensing via the dispensing ports 28A—28A. (As shown in FIG. 3.)

To facilitate dispensing wipers, the length of the major axis of the elliptically shaped region 28 is chosen to be relatively shorter than the width of wiper 12A; illustratively, the length of the major axis of the elliptical region 28 is approximately three-quarters of the width of the wiper. This length is significant because when the elliptical regions are removed from the carton, forming the dispensing ports 28A—28A, and a leading wiper is withdrawn from the storage compartment via port 28A, the slits, extending to both outer edges of the wiper web straddle the arc boundary surfaces of port 28A at the extremities of the major axis in a manner such that as the leading wiper is further pulled, perforation teeth breakage along perforation line 18A is initiated; to cause the lead wiper to separate from the trailing wiper. In addition to initiating perforation teeth breakage, the major axis arc boundary regions provide a retention force upon the leading wiper of the second web 16 as well as the trailing wiper of the first web 14 which are also pulled through port 28A as the lead wiper of the first web 14 is dispensed. This retention force holds these portions of the web poised for dispensing at a later time, providing a "pop-up" feature of this dispensing system.

In addition to the aforementioned characteristics of region 28—28, the length of the minor axis of this elliptically shaped region is made approximately one-third of the length of the major axis. This length forms arc boundaries for port 28A—28A associated with the minor axis which curve gradually as opposed to the relatively sharp curves associated with the major axis. These gradual-arc curved regions of port 28A—28A provide expansion space for the adhering surfaces of the leading wiper of second web 16 and the trailing wiper of the trailing wiper of web 14 to buckle in a manner causing the surfaces to detach breaking the mechanical bonds caused by the surfaces of the two different webs having a similar coefficient of friction characteristics.

Also as a desirable feature of this invention, the length of the minor axis for regions 28—28 is chosen to accommodate entry into ports 28A—28A, a hand of a size of an average man to extract a wiper to initiate the dispensing operation as well as to form a hand opening for grasping panel 30 used for hand carrying an open package.

To permit continuous dispensing of an entire stack of wipers in a compartment, top panel 26 is disposed at a height above the bottom of the carton which is at least equal to half the length of an extended and unfolded separable wiper.

For an illustration of application of the principles of the present invention to dispense interfolded meltblown microfiber web wipers from a dispensing carton, reference is now made to FIG. 3, which shows a carton 20 with an elliptical region 28 removed, providing a dispensing port 28A for dispensing wipers from storage compartment 22. Since dispensing of wipers from either storage compartment is identical, only one storage compartment and one dispensing port will be referred to hereinafter. Within the storage compartment, the stack of separable wipers are of such a height and width that an initial air gap of approximately one-eighth of an inch is preferred between the first wiper in the stack and the top panel. However, such an air gap is not a prerequisite for dispensing. Also, it is preferred but not a necessary requirement that approximately one-eighth inch clearance exists between a partition separating the two compartments, the side walls and the end flaps which form the storage compartment. To dispense the lead wiper 12A from web 14, the dispensing procedure requires the lead wiper 12A of web 14 to separate from the trailing wiper 12B of web 14, the lead wiper 12A of offset and lapping web 16 to pull through port 28A along with the trailing wiper 12B of web 14, and the lead wiper 12A of web 16 being poised in port 28A with at least the first half segment and the next full segment extending out of port 28A while only a portion of the half segment of trailing wiper of web 14 extending through port 28A.

In FIG. 3, there is shown the first and last teeth of line 18 abut against the arc boundary regions Q associated with major axis of the elliptically shaped port 28A. With further pulling force exerted on the lead wiper of web 14, the lead wiper will separate from the trailing wiper because the first and last slits of line 18 straddle the major axis arc boundary regions of port 28A, the resistive force exerted on the trailing wiper by the bottom of panel 26 at port 28A resist the pulling force of the lead wiper resulting in a tensile force of the teeth along line 18 to sever automatically without being separately manually detached.

Also shown in FIG. 3 is the buckling action of the trailing wiper of the lead web 14 and the lead wiper of the lagging and offset web 16 caused by port 28A being narrower along the major axis by at least $\frac{1}{3}$ than the width of the web and the minor axis being at least $\frac{1}{3}$ the length of the major axis, providing expansion room for the adhering webs to buckle breaking the mechanical bonds caused by materials having similar coefficient of frictions and substantially identical abrasion resistance. Note also that the half segment of the leading wiper of lagging web 16 straddles the gradual arc curve associated with the handle panel 30. Upon dispensing the lead wiper of lagging web 16 the first half segment at first full segments of the next leading wiper of web 14 will straddle the opposite gradual arc boundary B region poised in restraint in port 28A ready to be the next wiper to be dispensed. This alternating action of the wipers results from the adhering separable wipers in the interfolded webs being folded in alternating opposite directions.

It is understood that the above described embodiments are mainly illustrative of the principles of the invention. One skilled in the art may make changes and modifications to the embodiments disclosed herein and may devise other embodiments without departing from the scope and the essential characteristics thereof.

What is claimed is:

1. A combination carton and shipping package for shipping, storing and dispensing in pop-up fashion a series of folded meltblown microfiber material wipers therefrom, the surface of said wipers exhibiting a substantially high abrasion resistance characteristic between abutting surfaces which occurs in said folded state, said package comprising:

a. a pair of interfolded meltblown microfiber wiper webs disposed in zig-zag configuration in a storage compartment of said package as a stack of wipers; each of said webs being comprised of a plurality of folded wipers serially connected by transverse perforation teeth to form a substantially continuous web, each of said folded wipers being transversely folded into a plurality of zip-zag folds forming a first half-size segment, at least one intermediate full-size segment, and a second half-size segment; said perforation teeth being disposed between the second half-size segment of a leading wiper and the first half-size segment of a trailing wiper; said interfolded webs comprising a first web superposed over and physically adhered to a second web of said pair of webs, said first web being offset from said second web in a manner whereby the leading wiper of said second web lags the leading wiper of said first web; wherein said first and second interfolded webs have pattern imprints thereon formed from a pattern and anvil roll imprinting means; wherein said pattern roll surface of said first web is superposed upon said pattern roll surface of said second web; and wherein said pattern roll surface has a slightly greater imprint depth than the imprint of an anvil roll surface providing larger standoff indentations on the pattern roll side than if the depth of imprint was equal to the anvil roll imprint, reducing the coefficient of friction between the webs when the first and second webs are interfolded; and b. dispensing means for initiating breakage of the perforated teeth connecting said wipers in each of said continuous webs; said dispensing means including means for opposing physical adherence of said first web to the surface of said second web; the transverse perforation teeth of said first web being disposed midway between the transverse perforation teeth of the second web and vice versa; said dispensing means permitting the consumer to start the leading wiper of the first web being dispensed with his fingers; said dispensing means being responsive to physical force exerted on said leading wiper in said stack of wipers during the occurrence of removing said leading wiper from said stack.

2. Package in accordance with claim 1 including a second storage compartment disposed side-by-side with said storage compartment for providing stability to the package.

* * * * *